US009068479B2

(12) United States Patent
Hansson et al.

(10) Patent No.: US 9,068,479 B2
(45) Date of Patent: Jun. 30, 2015

(54) VEB EXCENTER RESET

(75) Inventors: Per Hansson, Göteborg (SE); Alexander Ölén, Ockero (SE)

(73) Assignee: Volvo Lastvagnar AB, Göteborg (SE)

( * ) Notice: Subject to any disclaimer, the term of this patent is extended or adjusted under 35 U.S.C. 154(b) by 476 days.

(21) Appl. No.: 13/516,245

(22) PCT Filed: Dec. 16, 2009

(86) PCT No.: PCT/SE2009/000518

§ 371 (c)(1),
(2), (4) Date: Sep. 21, 2012

(87) PCT Pub. No.: WO2011/075008

PCT Pub. Date: Jun. 23, 2011

(65) Prior Publication Data

US 2013/0042835 A1 Feb. 21, 2013

(51) Int. Cl.

| | |
|---|---|
| ***F02D 13/04*** | (2006.01) |
| ***F01L 9/02*** | (2006.01) |
| ***F01L 1/18*** | (2006.01) |
| ***F01L 1/26*** | (2006.01) |
| ***F01L 13/00*** | (2006.01) |
| ***F01L 13/06*** | (2006.01) |

(52) U.S. Cl.

CPC ..... *F01L 1/182* (2013.01); *F01L 1/265* (2013.01); *F01L 1/267* (2013.01); *F01L 13/0026* (2013.01); *F01L 13/0036* (2013.01); *F01L 13/06* (2013.01); *F02D 13/04* (2013.01); *F01L 2001/186* (2013.01)

(58) Field of Classification Search

CPC ..... F01L 1/181; F01L 1/185; F01L 9/02; F01L 13/0005; F01L 13/05; F01L 13/065; F02D 9/06; F02D 13/04; F02D 2041/001

USPC ..... 123/90.12, 90.16, 90.25–90.27, 90.2, 123/90.39, 90.46, 320, 321

See application file for complete search history.

(56) References Cited

U.S. PATENT DOCUMENTS

| | | | | |
|---|---|---|---|---|
| 5,507,261 | A * | 4/1996 | Johnson, Jr. | 123/322 |
| 6,253,730 | B1 * | 7/2001 | Gustafson | 123/321 |
| 6,450,144 | B2 * | 9/2002 | Janak et al. | 123/321 |
| 6,694,933 | B1 | 2/2004 | Lester | |
| 2004/0168660 | A1 * | 9/2004 | Persson et al. | 123/90.17 |
| 2005/0000498 | A1 * | 1/2005 | Persson | 123/568.14 |
| 2006/0081213 | A1 | 4/2006 | Yang et al. | |

FOREIGN PATENT DOCUMENTS

| | | | |
|---|---|---|---|
| WO | 0146578 | A1 | 6/2001 |
| WO | 02095203 | A1 | 11/2002 |

OTHER PUBLICATIONS

Supplementary European Search Report (Aug. 20, 2013) for corresponding European App. EP 09 85 2346.

Chinese Search Report (Jan. 16, 2014) for corresponding Chinese App. 200980162959.2.

International Search Report (Sep. 9, 2010) for corresponding international application No. PCT/SE2009/000518.

* cited by examiner

*Primary Examiner* — John Kwon
*Assistant Examiner* — Johnny H Hoang
(74) *Attorney, Agent, or Firm* — WRB-IP LLP

(57) ABSTRACT

A valve mechanism for an internal combustion engine is operable to selectively open and close a gas exchange valve to accomplish an engine brake during an engine brake mode of an engine. The valve mechanism includes a cam follower in biased abutment against a gas exchange cam element for actuation of a rocker arm connected to the gas exchange valve.

16 Claims, 7 Drawing Sheets

VEB EXCENTER RESET

BACKGROUND AND SUMMARY

The invention relates to a gas exchange valve mechanism for an internal combustion engine. In particular the invention relates to a gas exchange valve mechanism for an internal combustion engine operable to selectively open and close a gas exchange valve to accomplish an engine brake during an engine brake mode of an engine.

In order to provide efficient braking systems on vehicles, supplementary brake systems to the disc or drum brakes are frequently provided. An example of such a system is an engine compression braking system. Engine compression braking generally operates such that the engine is operated in a braking mode where little or no fuel is supplied to the cylinder or cylinders operating in a braking mode. The piston is allowed to compress the gas present in the cylinder. Before expansion takes place a valve is opened to discharge the compressed air. Power is consumed during the compression of the gas which results in braking of the engine. The control of opening and closing of a valve included in the engine compression braking system may be performed by valve mechanism for an internal combustion engine operable to selectively open and close a valve to accomplish an engine brake during an engine brake mode of an engine. The gas exchange valve mechanism includes a cam follower in biased abutment against a cam element for actuation of a rocker arm connected to said gas exchange valve. The rocker arm is connected to the valve for controlled actuation thereof. The compression and discharge of compressed air may suitable take place during a compression stroke of the engine. An example of an engine compression braking system is provided in U.S. Pat. No. 6,253,730.

U.S. Pat. No. 6,253,730 relates to an exhaust valve mechanism for an internal combustion engine. The exhaust valve mechanism includes a cam shaft having an exhaust valve cam element including a main lift portion and at least one brake lift portion. During the main lift portion the rocker arm opens the exhaust valve or valves of a cylinder to reach a fully open position to enable scavenging of exhausts during a normal power mode of the engine. During the brake lift portion the gas contained in the cylinder should be discharged after having been compressed at a compression stroke in order to achieve engine braking. The brake lift portion is considerably smaller than the main lift portion and occurs preferably at the end of the compression stroke. A further brake lift portion may be provided at the beginning of the compression stroke or just before the compression stroke in order to admit gas at higher pressure at an exhaust manifold enter the cylinder when the gases in the cylinder has a lower pressure which is the case around bottom dead centre of the piston.

The exhaust valve mechanism according to U.S. Pat. No. 6,253,730 furthermore includes a rocker arm mounted on a rocker arm shaft, said rocker arm provided with a cam follower in biased abutment against the exhaust valve cam element for actuation of the rocker arm.

In order to allow the gas exchange valve mechanism to operate during both normal power mode of the engine and engine compression braking mode, the gas exchange valve mechanism further includes an actuator piston bore formed in the rocker arm. The actuator piston bore defining an actuator cylinder housing an actuator piston slidably arranged in said actuator cylinder. The actuator piston is arranged in abutment with a gas exchange valve for selective actuation of the gas exchange valve. A braking fluid circuit is formed in the rocker arm. The braking fluid circuit connecting said piston bore with a control valve selectively connecting the braking fluid circuit to a braking fluid supply line or a braking fluid drain line. Depending on whether the braking fluid circuit is connected to the supply line or drain line, a high or a low brake fluid pressure will be present on the remote side to the actuator piston with relation to reset valve, the During normal operation the actuator cylinder will not be supplied with high pressure braking fluid and the actuator piston will not transmit sufficient pressure to the gas exchange valve to obtain opening of the same. Instead, the actuator piston will be pressed into the actuator cylinder. When the cam follower enters the main lift portion a contact shoe is engaged with the gas exchange valve or a gas exchange valve overhead to allow the continued movement of the rocker arm to open the gas exchange valve during the gas exchange gas discharge stroke.

The gas exchange valve mechanism further includes a reset valve being arranged in the braking fluid circuit to open or close a connection between said piston bore and said control valve. Opening of the reset valve allows discharge of brake fluid from the actuator cylinder and closing of the gas exchange gas valve. A reset valve actuator mechanism controlling actuation of said reset valve is included to in the gas exchange valve mechanism. The reset valve actuator mechanism disclosed in U.S. Pat. No. 6,253,730 includes a reset contact element mounted on an engine component. The position of the reset contact element is such that a stem on the reset valve engages with the reset contact element when the rocker arm is at a desired location. That is the rocker arm must have lifted the exhaust gas valve to a certain position before unloading of the pressure in the actuator cylinder may take place.

This leads to that the opening of the reset valve cannot be performed independently of the position of the rocker arm. Since the opening of the reset valve requires that the rocker arm proceeds beyond the fully open stage of the gas exchange valve obtained by the brake lift portion, otherwise contact would already have been established between the reset contact element and the reset valve, opening of the reset valve is performed when the brake fluid in the actuator cylinder is set under pressure due to the compression of a valve spring made by the actuator piston. The necessity to open the reset valve when brake fluid in the actuator cylinder defined in the piston bore is set under pressure leads to increased wear of the components and increased requirements for structural rigidity of the components, which may lead to heavier and more bulky design of the arrangement.

It is desirable to enable slimmer design of a gas exchange valve mechanism for an internal combustion engine. It is also desirable to provide an arrangement which enables opening of a reset valve at a desired operating point independently of the pivotal position of the rocker arm.

The invention relates, according to an aspect thereof, to a valve mechanism for an internal combustion engine operable to selectively open and close a gas exchange valve to accomplish an engine brake during an engine brake mode of an engine. The valve mechanism includes a cam follower in biased abutment against a cam element for actuation of a rocker arm connected to the gas exchange valve.

The connection between the rocker arm and the gas exchange valve may be performed via an actuator piston housed in a bore formed in the rocker arm.

The actuator piston may be arranged in abutment with a gas exchange valve for selective actuation of the gas exchange valve.

According to the invention the valve mechanism further includes a reset valve actuator with a second cam follower in biased abutment against a reset valve cam element for actuation of a reset valve.

Since the actuation of the reset valve is controlled by a cam element the opening and closing of the reset valve may be accomplished independently of the position of the rocker arm. This enables opening of the reset valve in a situation when the gas exchange valve is closed.

The gas exchange valve may preferably be an exhaust valve.

The gas exchange cam element may be arranged on a cam shaft and include a main lift portion and at least one brake lift portion. The main lift portion may control the lift of an exhaust valve for scavenging of exhaust gases from a combustion chamber of the engine during an exhaust stroke under normal operation of the engine. The brake lift portion ensures that compressed gas may be released via the gas exchange valve during engine brake.

The valve mechanism may further include an actuator piston bore formed in the rocker arm. The actuator piston bore housing an actuator piston slidably arranged in said actuator piston bore. The actuator piston is arranged in abutment with a gas exchange valve for selective actuation of the gas exchange valve.

The valve mechanism may further include a braking fluid circuit formed in said rocker arm, said braking fluid circuit connecting said piston bore with a control valve selectively connecting the braking fluid circuit to a braking fluid supply line or a braking fluid drain line. The control valve selectively enables the valve mechanism to operate in either of a normal operation power mode or in a engine brake mode depending on whether the control valve supplies pressurized braking fluid to the piston bore or not.

The reset valve is arranged in the braking fluid circuit to allow draining of oil trapped in the open or close a connection between said piston bore and said control valve.

The reset valve cam element and said gas exchange valve cam element may be provided on a common cam shaft.

The reset valve cam element and said gas exchange valve cam element may be separate elements or formed as a single cam element. In any case two separate cam followers are used, one enabling control of the gas exchange valve via the pivotal position of the rocker arm and one enabling control of the reset valve element via a reset valve actuator. The use of two separate cam followers enables independent control of the reset valve in relation to the pivotal position of the rocker arm. It is hence possible to open the reset valve in an unloaded state when the rocker arm does urge the gas exchange valve into an open position. In this state the brake liquid in an actuator piston bore will not be set under pressure due to the contact between the rocker arm and the actuator piston, leading to lower wear of the components and lower requirements for structural rigidity of the components.

The second cam follower may include an arced concave portion faced toward said cam element. The use of an arced cam follower instead of a cam follower providing a distinct single point contact, such as the contact between a cam and a cam roller, enables extended contact between a cam peak and the cam during rotation of the cam shaft. A prolonged opening time of the reset valve can then be accomplished facilitating use of a common cam element for the gas exchange valve and the reset valve.

The reset valve actuator may include a reset member which is pivotally supported around an axis which is parallel and off set in relation to a pivot axle for said rocker arm. The reset member may be arranged to be pivoted by said reset valve cam element via the second cam follower. The second cam follower may be an integral part of the reset member.

The reset member may include a trace or opening having an extension in a circumferential direction allowing a reset valve stem to remain in an extended position while said second cam follower is positioned on a base circle of said reset valve cam element during movement of said first cam follower around the periphery of said exhaust valve cam element.

The reset member may further include a ramp portion extending in a radial direction from said trace or opening allowing a reset valve stem to transfer between an extended position when said valve stem is located in said trace or opening to a retracted position due to a relative movement of said valve stem and ramp portion in a radial direction following a pivoting movement of said reset member.

The reset valve stem may reach its fully retracted position at a maximum height of the reset valve cam element.

BRIEF DESCRIPTION OF DRAWINGS

Embodiments of the invention will be described in further detail below with references to appended drawings where.

DETAILED DESCRIPTION

Figure 1:
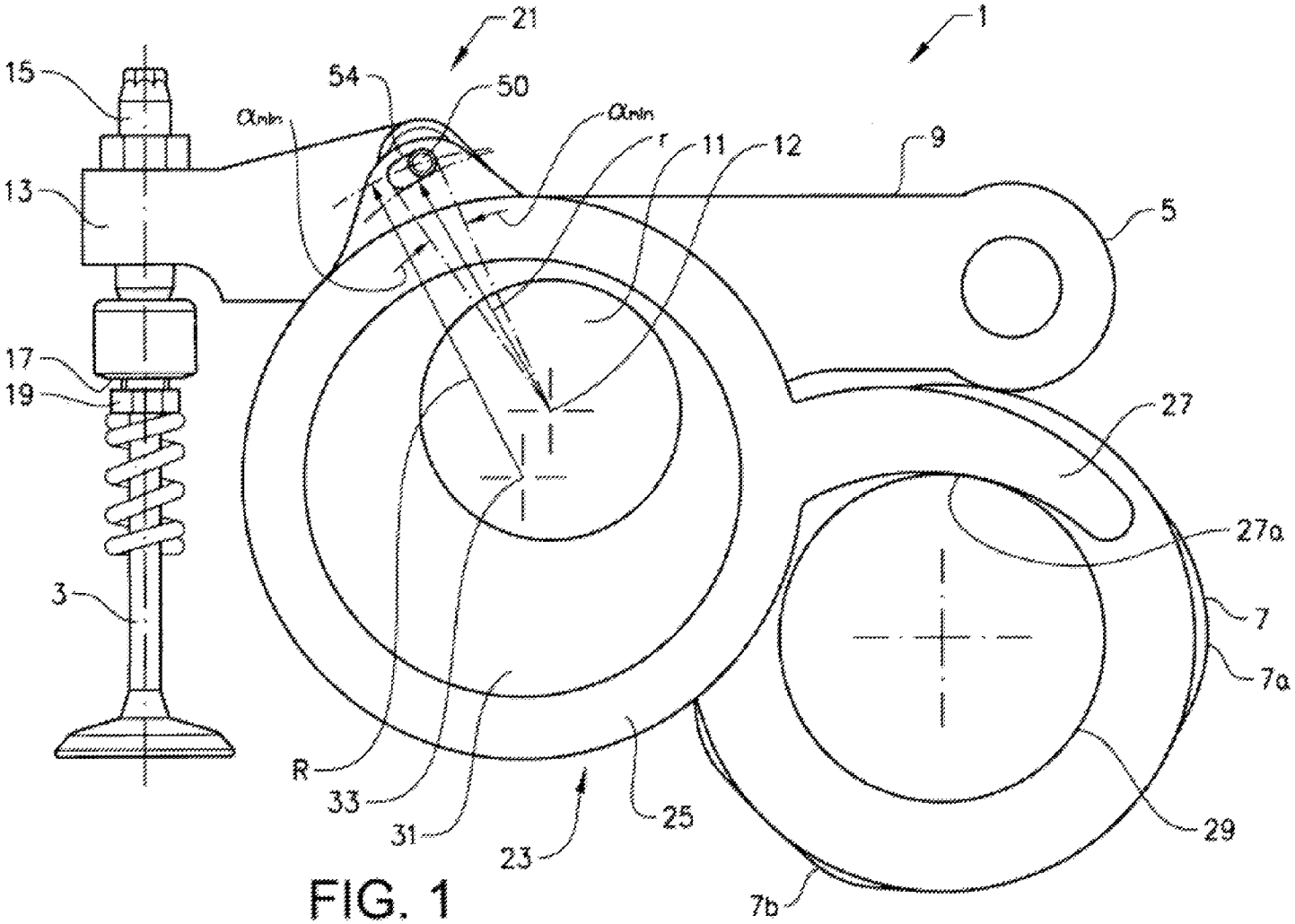
FIG. 1 shows a side view along an extension of a cam shaft of an engine of a valve mechanism according to the invention.

In FIG. 1 a valve mechanism 1 according to the invention is shown. The valve mechanism is shown in a direction across a cam shaft of an internal combustion engine. The valve mechanism is operable to selectively open and close a gas exchange valve 3 to accomplish an engine brake during an engine brake mode of an engine. The valve mechanism 1 comprises a cam follower 5 in biased abutment against a gas exchange cam element 7 for actuation of a rocker arm 9 connected to the gas exchange valve 3. Such valve arrangements are commonly known and described in for instance U.S. Pat. No. 6,253,730 or WO2009/019269. The rocker arm is supported by a pivot axle 11 allowing the rocker arm 9 to pivot as the cam follower follows the contour of the gas exchange cam element 7. The pivot axle has a centre which forms a pivot axis 12 for the rocker arm. The gas exchange valve 3 is normally constituted by an exhaust valve allowing scavenging of exhaust in an exhaust stroke of a piston arranged in a cylinder defining a combustion chamber of the engine. In this event the gas exchange cam element includes a main lobe 7*a* defining a main lift portion corresponding to the opening movement of the exhaust valve during the exhaust stroke. The cam element 7 further includes at least one brake lobe 7*b* defining at least one brake lift portion. The height and shape of respective lobes are designed to enable appropriate lift of the exhaust valve during the exhaust stroke and to open the exhaust valve to an appropriate degree during release of compressed gases at engine brake. The rocker arm 9 includes a portion 13 which engages with the exhaust valve 3. The portion 13 of the rocker arm engaging with the exhaust valve 3 may carry a set screw 15 for precisely defining the location of an engagement surface 17 of the rocker arm in relation to a valve cap 19. The rocker arm 9 further includes a reset valve arrangement 21 which will be described in further detail in relation to FIG. 2. The reset valve arrangement includes a reset valve 22, which is here embodied by a ball 44 and valve seat 42. The seating defines a passage 43 in a braking fluid circuit connecting an inner space 24 defined by an actuator piston 53 and cylinder 51 arranged in or at the rocker arm 9 with the reset valve 22.

Figure 1A:
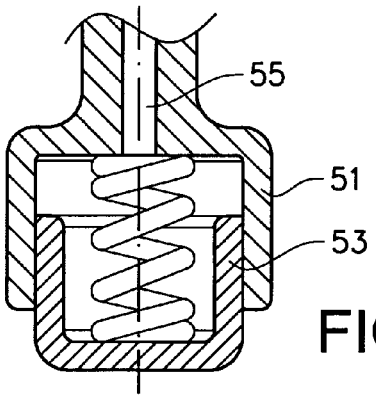
FIG. 1*a* shows a detail of FIG. 1 shown in cross section.

The valve mechanism 1 further includes a reset valve actuator 23. The reset valve actuator 23 is arranged to open and close the reset valve 22. The reset valve 22 arranged in a braking fluid circuit connecting the inner space 24 with a control valve 59. The braking fluid circuit includes a brake fluid conduit 55 which connects the inner space 24 with the reset valve 22, as shown in FIG. 1*a*. The braking fluid circuit furthermore includes a passage 43 defined by a seating 42 of the reset valve 22. The braking fluid circuit also includes an inlet conduit 49 is connected to a pressure chamber 45 defined in the reset valve 22. The inlet conduit 49 is connected to fluid conduit 57 leading to an outlet port of the control valve 59. The control valve 59 enables selective connection of the braking fluid circuit to a braking fluid supply line or a braking fluid drain line.

The reset valve actuator 23 includes a cam element 29, a second cam follower 27, and a reset member 25, as will be explained in more detail below. The reset valve arrangement 21 is shown in cross section along an axis parallel with a cam shaft in FIG. 2. When the reset valve is open a communication between the control valve 59 and the actuator cylinder 51 in which the actuator piston 53 is housed is allowed. The actuator cylinder 51 is formed in a protruding part of the rocker arm 9 as shown in FIG. 1*a*. The actuator piston 53 is arranged to be in abutment with a valve cap 19 for movement of the gas exchange valve 3. The actuator cylinder 51 and the actuator piston 53 defines the inner space 24 which may be supplied with brake liquid to enable opening of the gas exchange valve 3 before a rocker arm shoe (not shown) engages with a valve overhead to open both valves during an exhaust stroke, such that a brake mode may be accomplished in a manner as described in for instance U.S. Pat. No. 6,253,730.

The reset valve 22 may preferably be designed as a ball check valve 40 allowing fluid to flow from the control valve 59 to the inner space 24 of the actuator cylinder 51 via a passage 43 defined by the valve seat 42 in the reset valve 22, while preventing flow of braking fluid in the opposite direction unless the reset valve 22 is opened. The flow of the braking fluid is controlled by a ball 44 arranged in a space 46 and having a spring 48 urging the ball against the valve seat 42 for closing of the passage 43. A reset valve stem 50 may be urged to open the passage 43 by pressing the ball 44 against the spring 48. The reset valve stem 50 is biased in a direction toward the ball by a spring 52.

The inlet conduit 49 is connected to the fluid conduit 57 in a braking fluid circuit connecting said inner space 24 of the actuator cylinder 51 with a control valve 59 selectively connecting the braking fluid circuit to a braking fluid supply line 61 or a braking fluid drain line 63. Depending on whether the braking fluid circuit is connected to the supply line 61 or drain line 63, a high or a low brake fluid pressure will be present in the pressure chamber 45.

During normal operation the actuator cylinder will not be supplied with high pressure braking fluid. The spring 52 will therefore act on the reset valve stem to open the reset valve. Hence, the actuator piston 53 will not transmit sufficient pressure to the gas exchange valve to obtain opening of the same. Instead, the actuator piston will be pressed into the actuator cylinder.

When a low pressure is present in a pressure chamber 45 defined in a reset valve housing 47, which is the case when the braking fluid drain line is connected via the control valve 59, the spring 52 will urge the ball 44 from its seat and the reset valve will be open. A low pressure in the pressure chamber will be present when the engine operates in normal combustion mode.

When a high pressure is present in the pressure chamber 45 defined in the reset valve 22, which is the case when a inlet conduit 49 is connected to braking fluid supply line, the spring 52 will be compressed by the pressure in the pressure chamber and the valve stem will be allowed to penetrate into the slot or recess 54 in a reset member 25. A slot may be used if encapsulation of a reset valve stem head 58 is not desirable. A recess may be used if encapsulation of the reset valve stem head 58 is desirable. When the valve stem has penetrated into the slot or recess 54, the ball 44 will be pressed against its seat by the spring 48 and the reset valve will be closed. A high pressure in the pressure chamber will be present when the engine operates in engine brake mode. When the relative position between the slot or recess and the valve stem 50 is altered via movement of the reset member 25 caused by the movement of the second cam follower 27, the reset valve stem will be made to leave the slot or recess and the reset valve stem will open the reset valve.

The reset valve arrangement 21 may be housed in the rocker arm 9, is suitably arranged in a direction such that the reset valve stem is parallel with a length axis of a cam shaft of the engine. The reset valve stem 50 protrudes out from the rocker arm and into the slot or recess 54 in a reset member 25. The reset member 25 and its function are readily apparent from FIG. 1. The reset member 25 is connected to a second cam 27 follower in biased abutment against a reset valve cam element 29 for actuation of the reset valve stem to open and close the orifice by moving the reset valve stem. In the embodiment shown in FIGS. 1-8, the reset cam element is arranged on a common shaft carrying the reset cam element and gas exchange cam element and is formed as a separate element. It is however possible to use a common cam element that serves as both a gas exchange cam element and as a reset valve cam element. The second cam follower is preferably an integrated part of the reset member 25, which may be formed as a disc having an arc shaped cam follower extending there from. The second cam follower may include an arced concave portion 27*a* faced toward said cam element. This enables that a peak of a reset lobe on the reset cam element to be in contact with the second can follower during an extended period. The reset member 25 is pivotally supported around a pivot element 31 which is eccentrically arranged in relation to the pivot axle 11.

When the rocker arm pivots due to the movement of the cam follower 5 in biased abutment with the gas exchange cam element 7, the protruding portion of the reset valve stem 50 will perform an arced movement with respect to the reset member 25. When the reset cam follower 27 is on a base circle of the reset cam element 29 the arced movement of the reset valve stem in a direction transverse to the length axis of the valve stern 50 will be constituted by a circle segment having a radius r which is the distance between a centre of the pivot axle 11 and a centre of the valve stem 50. The slot or recess 54 of the reset member has an arced shaped portion allowing the reset valve stem to be in an extended position during movement of the rocker arm. A ramp portion 65 may be present in abutment with the slot or recess 54. The ramp portion will come into contact with the reset valve stem when the second cam follower 27 leaves its base circle defining the radial relative position between the reset valve stem and the reset member 25. When the second cam follower 27 is positioned on the base circle of the reset cam element 29, the reset valve stem 50 will be located in the slot or recess 54 allowing full extension of the reset valve stem such that the reset valve is not opened. When the second cam follower 27 leaves the base circle, the relative position between the reset valve stem 50 and the reset member 25 will be altered such that the reset valve stem 50 may leave the slot or recess 54 and enter to the ramp portion 65 resulting in that the reset valve stem is forced towards the ball 44. When the second cam follower has reached a certain height the reset valve stem will be located at a reset portion area 67 of the reset member, where the reset member will urge the reset valve stem to push the ball to open the valve.

Figure 4:
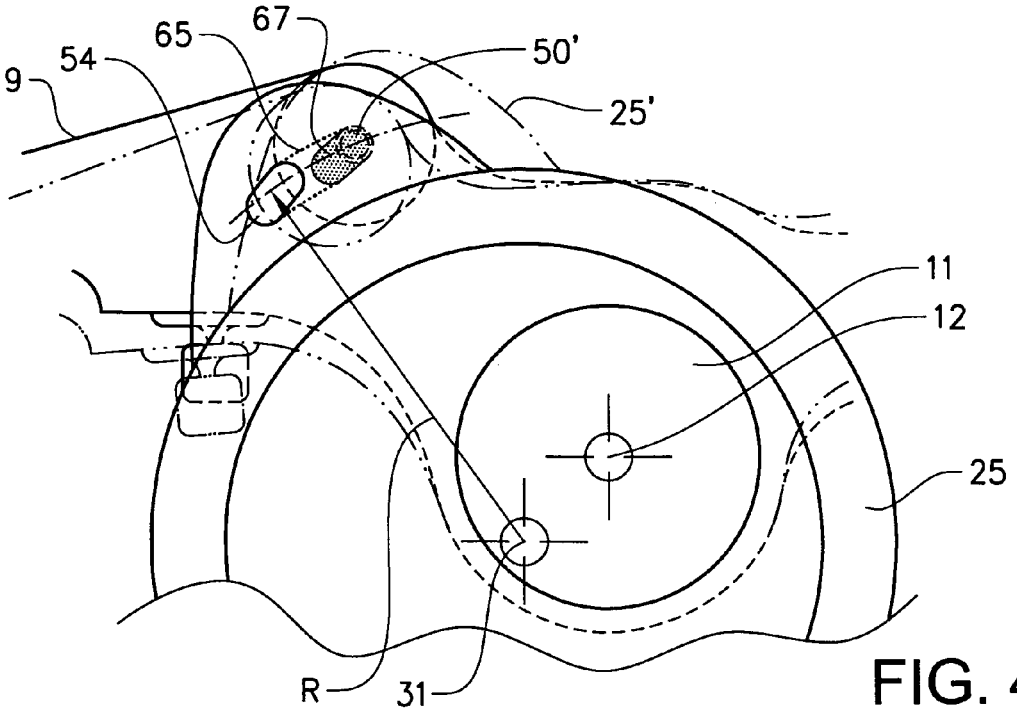
FIG. 4 shows in detail a reset valve stem in a third position outside of a slot arranged in a reset member in a valve mechanism according to the invention.

In FIG. 4, the slot or recess 54, and the reset portion area are indicated. The slot or recess 54 defines an area where the stem projected on the reset member when the valve is not forcedly opened by the reset member. The reset portion area is the area where the reset valve stem is in contact with the reset member when the reset valve is fully opened and the ramp portion is an area connecting the slot or recess 54 with the reset portion area 67. Since the reset valve stem performs a reciprocating motion in a cross axial direction due to the movement of the rocker arm also during the time when the valve is in the opened state the reset portion area 67 will have an arced shape. The ramp portion allows a smooth transition between the reset portion area and the slot or recess 54.

That is the shape of the lobes 7*a*, 7*b* on the gas exchange cam element 7 may be such that the arced movement of the reset valve stem 50 in relation to the reset member 25, when the reset cam follower 29 is On its base circle, performs an arced movement in the form of a circle segment having an opening angle between the angles amjn and amax. The slot or recess 54 may extend such that the reset valve stem 50 may be fully extended such to not urge the valve stem 50 to open the reset valve 22 during a full revolution of the gas exchange cam element 7.

As have been explained above, the reset member 25 is pivotally supported around an axis 33 which is parallel and off set in relation to a pivot axis for said rocker arm. When the reset member 25 is pivoted around the pivot axis 33 resulting from actuation by the second cam follower 27, a relative movement between the reset valve stem 50 and the reset member will take place. It should be noted here that the terms radial and circumferential direction are referred to a polar coordinate system having its centre at the pivot axis 12 of the pivot axle 11 for the rocker arm, not at the pivot axis 33 of the reset member 25. For this reason recess member is provided with a ramp portion 65 in abutment with the slot or recess 54. When the second rocker arm 27 leaves its base circle, a relative movement will take place between the valve stem 50 and the reset member in the radial direction, allowing the ramp portion 65 to engage with the reset valve stem 50 to open the reset valve. The reset member 50 thus includes a slot or recess 54 which has an arced portion having a shape of a circle segment having an opening angle at least between the angles amin and aopen or amax. The extension of the arced portion of the slot of the recess in a radial direction is such that the reset valve stem does not open the valve when present in the slot or recess. The slot or recess 54 has thus a base with a radial extension exceeding a diameter of the valve stem. The reset member also includes ramp portion 65 which abuts the slot or recess and forms a shoulder thereof. The ramp portion would optionally be located radially inside and/or outside of the slot or recess. Due to that when turning the reset member, the relative movement between the reset valve stem and the reset member will be arc shaped around the pivot axis 33, which is off set in relation to the pivot axis 12 and has a different radius R. The reset valve stem will thus leave the slot or recess and enter into the ramp portion when the second cam follower leaves the base circle of the reset cam element. The ramp portion can be located either radially inside or radially outside of the base portion or both radially outside and inside of the base portion.

Figure 2:
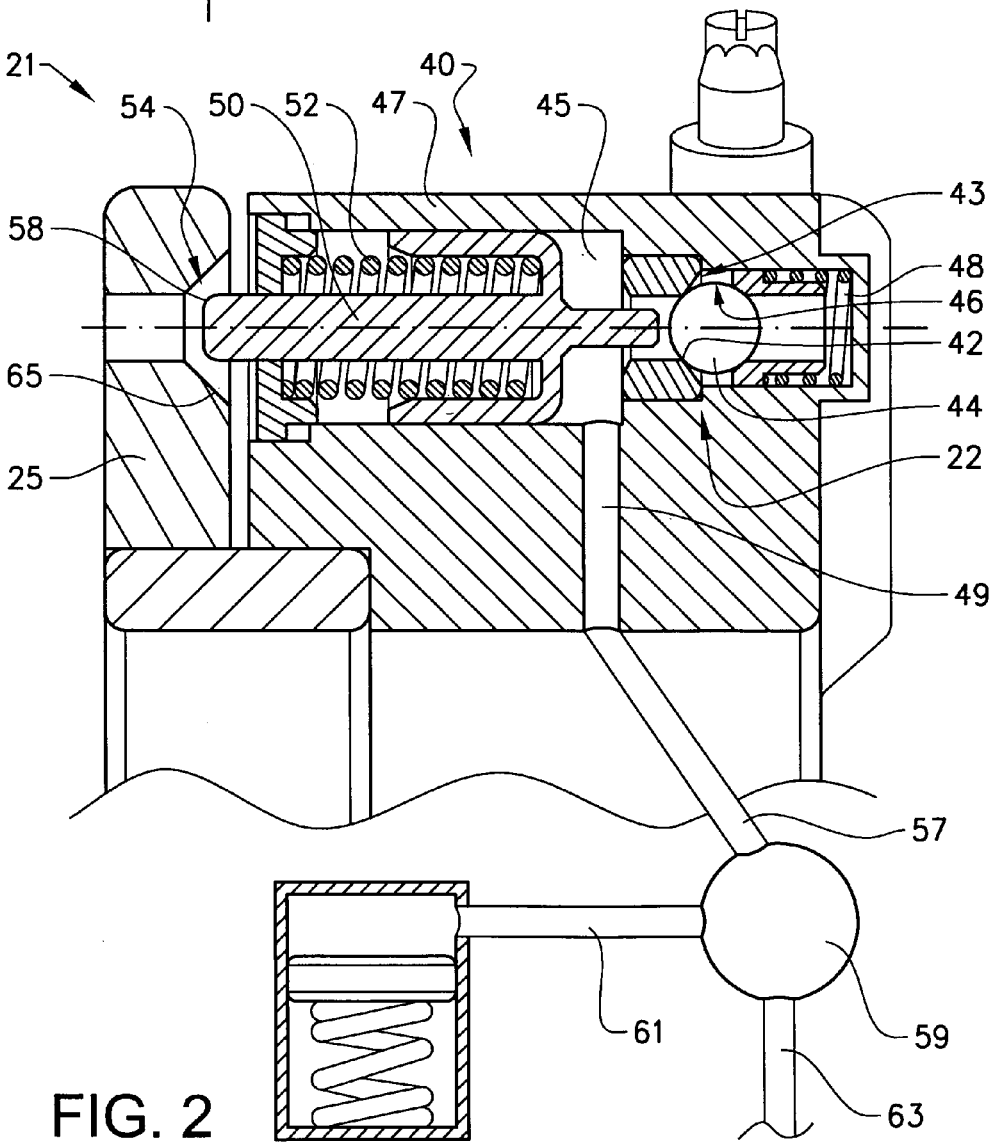
FIG. 2 shows a cross section of a reset valve arrangement.

In FIGS. 1 and 2, the reset valve stem is located in the slot or recess at the position amjn corresponding to that both the first cam follower and the second cam follower are located on respective cam elements base circles.

Figure 3:
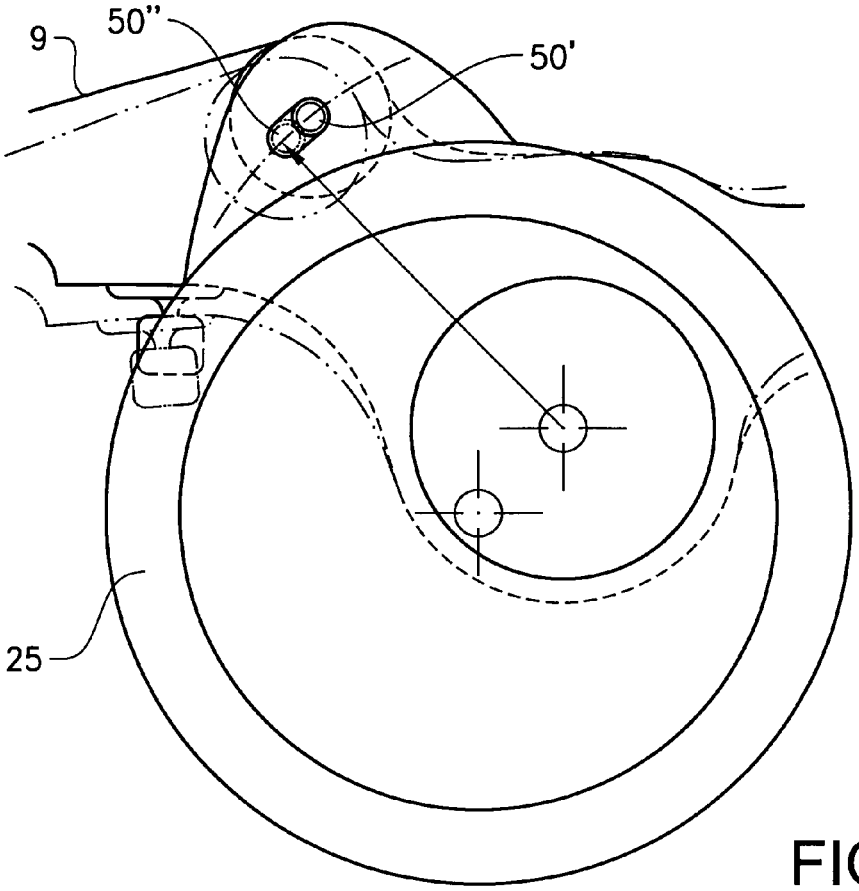
FIG. 3 shows in detail a reset valve stem in a second position in a slot arranged in a reset member in a valve mechanism according to the invention.

In FIG. 3, is shown two alternate positions of the reset valve stem 50 in the slot or recess 54 of the reset member 25, when the reset member is positioned in power mode. When the first cam follower has left the base circle and is on a height corresponding to the maximum allowed pivotal position of the rocker arm position the reset valve stem 50' assumes the position amax indicated with a continuous line, and when the first cam follower is located on the base circle position the reset valve stem 50" assumes the position amin indicated with a dashed line. The second cam follower is located on the base circle of its cam element. Reset valve stem is thus positioned in the slot or recess. The rocker arm 9 is partly shown in the figure.

In FIG. 4, the reset valve stem 50 is located outside of the slot or recess 54. In the figure two alternate positions of the reset valve stem in the slot or recess are shown. When the first cam follower has left the base circle and is on a height corresponding to the maximum allowed pivotal position of the rocker arm position the reset valve stem assumes the position amax indicated with a continuous line, and when the first cam follower is located on the base circle position the reset valve stem assumes the position amjn indicated with a dashed line. The second cam follower is has left the base circle of its cam element. The reset valve stem has moved from the slot or recess 54, where the reset valve stem may be fully extended via the ramp portion 65 into a reset position area 67 where the reset valve is fully opened by pressing the reset valve stem toward the ball 44. The original position of the reset element is indicated with a dashed line and is represented with reference number 25'.

Figure 5:
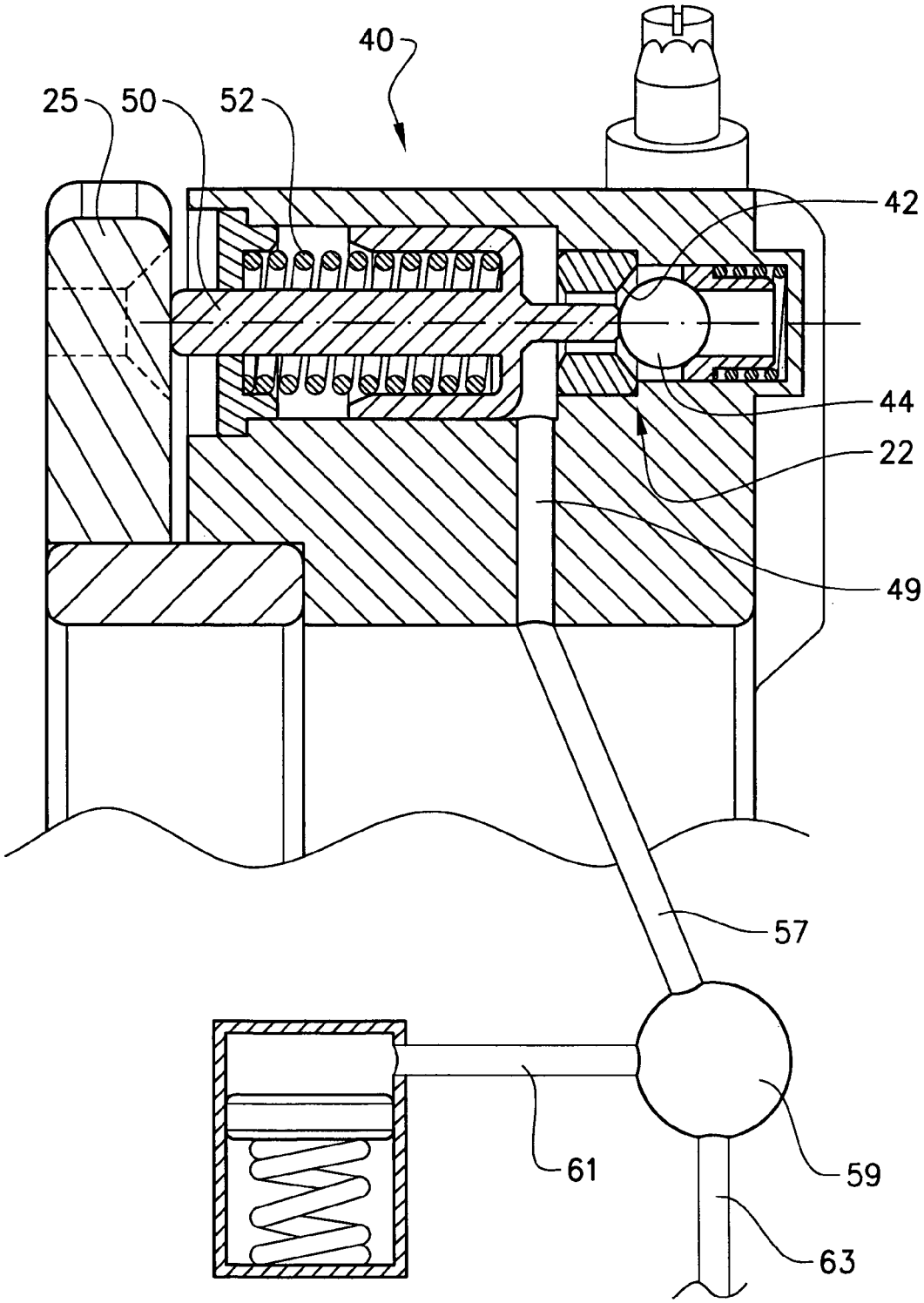
FIG. 5 shows a cross section of a reset valve arrangement when the reset valve stem is in the third position indicated in FIG. 4.

The reset member thus engages with the reset valve stem 50 to open the reset valve, as is indicated in FIG. 5. Here the reset member 25 has urged the reset valve stem 50 to lift the ball 44 from the seat 42.

Figure 6:
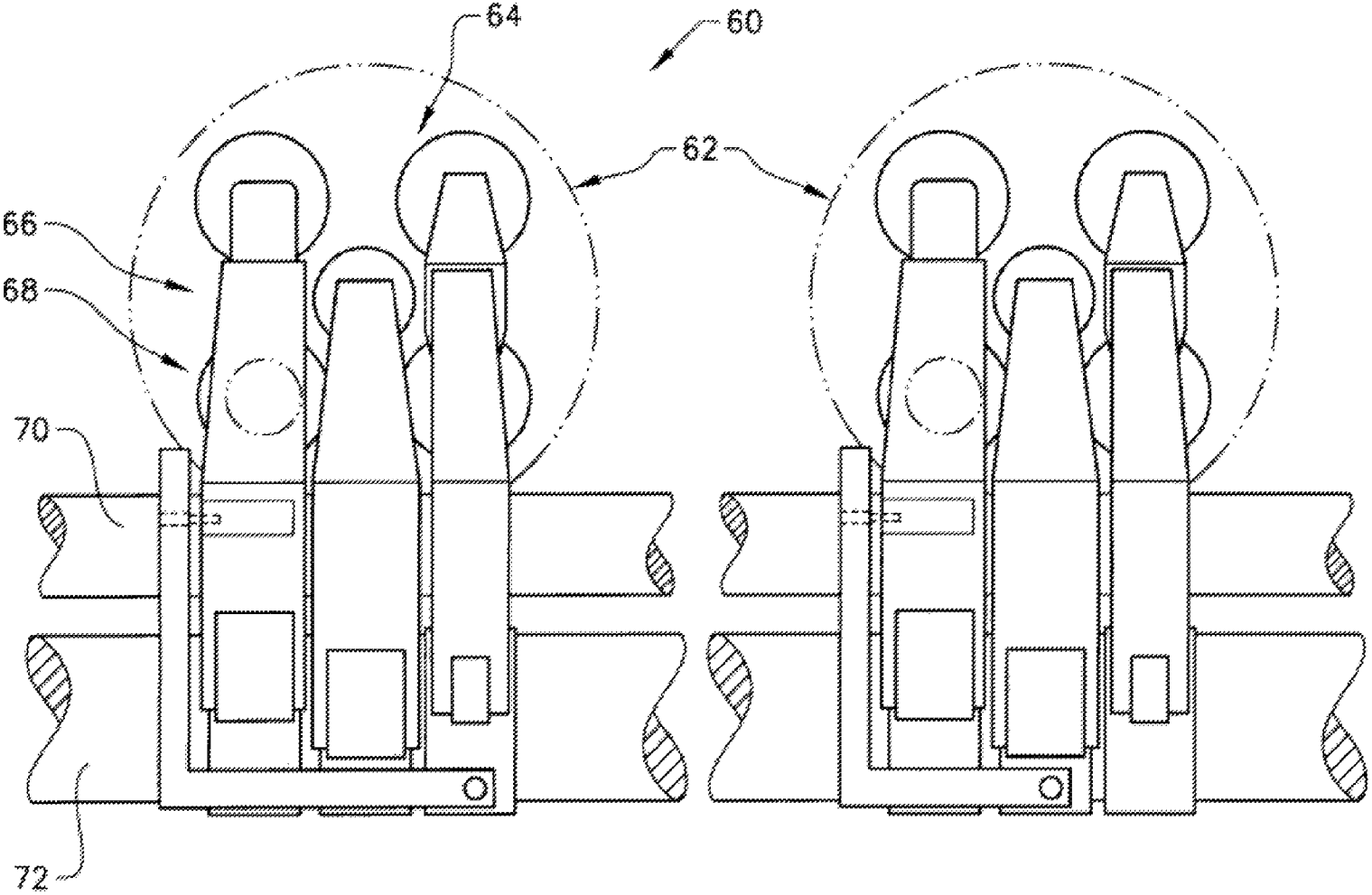
FIG. 6 shows a top view of a part of a combustion engine including a set of cylinders and a valve arrangement according to the invention.
Figure 7:
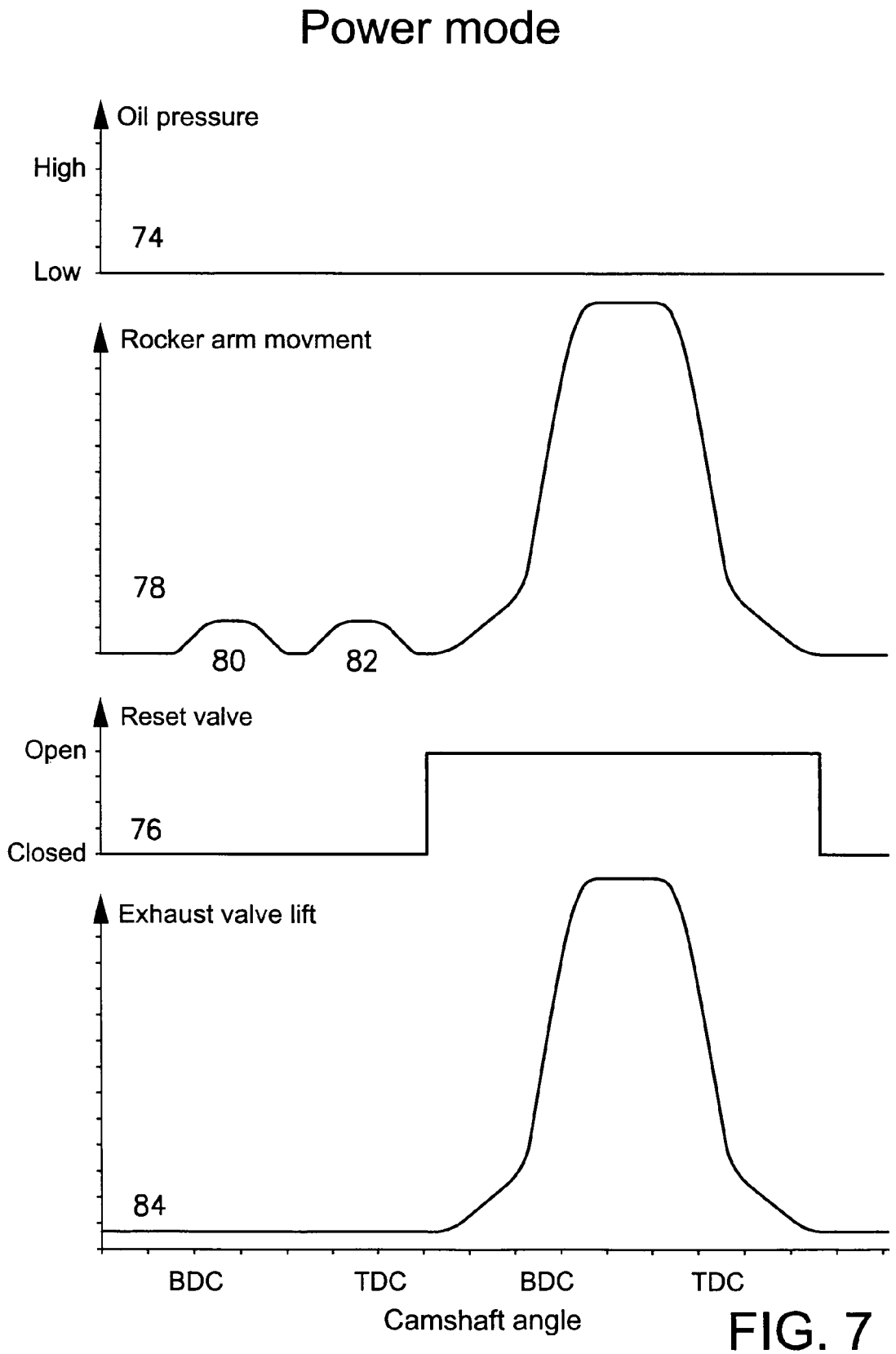
FIG. 7 shows the rocker arm movement and exhaust valve lift during a normal power mode.

In FIG. 6 a schematic drawing of combustion engine 60 including a set of cylinders 62. An intake valve arrangement 64 and an exhaust valve arrangement 66 are included. The exhaust valve arrangement 66 is arranged in accordance with what have been described above and includes an exhaust valve 68 selectively controllable so as to allow opening and closing to enable operation of a normal power mode and an engine brake mode. The exhaust valve arrangement includes a second exhaust valve which merely operates in a normal operating mode and therefore does not participate by opening during the engine braking mode. The exhaust valve arrangement 66 may be arranged as described in U.S. Pat. No. 6,253, 730, with the difference that the control of the reset valve is performed as described above. The rocker arms for the intake and exhaust valves are pivotally supported on a common pivot axle 70. A common cam shaft 72 support cam elements for the intake valves, exhaust valve and the reset and a valve arrangement according to the invention FIG. 7 shows the rocker arm movement and exhaust valve lift during a normal power mode. It should be noted that the brake fluid pressure from the control valve is low during the entire operation as indicated in the upper diagram 74. This leads to the reset valve is opened during normal power mode.

The rocker arm movement indicated in the middle diagram 76 reflects the shape of the gas exchange cam element and includes lobes defining a main exhaust lift 78 and two engine brake lifts 80, 82. Since the pressure is low in the actuator cylinder, the gas exchange valve cannot be opened by the movement of the rocker arm during the brake lifts. The shape of the reset valve cam element will however enable release during the main lobe 78 such that low pressure brake fluid trapped in the actuator cylinder does not prevent the actuator piston to assume a base position which precisely defines the intended lift of the exhaust valve during power stroke. The resulting exhaust valve lift is shown in the lower diagram 84. It should be noted that the exhaust valve is only open during the exhaust stroke.

Figure 8:
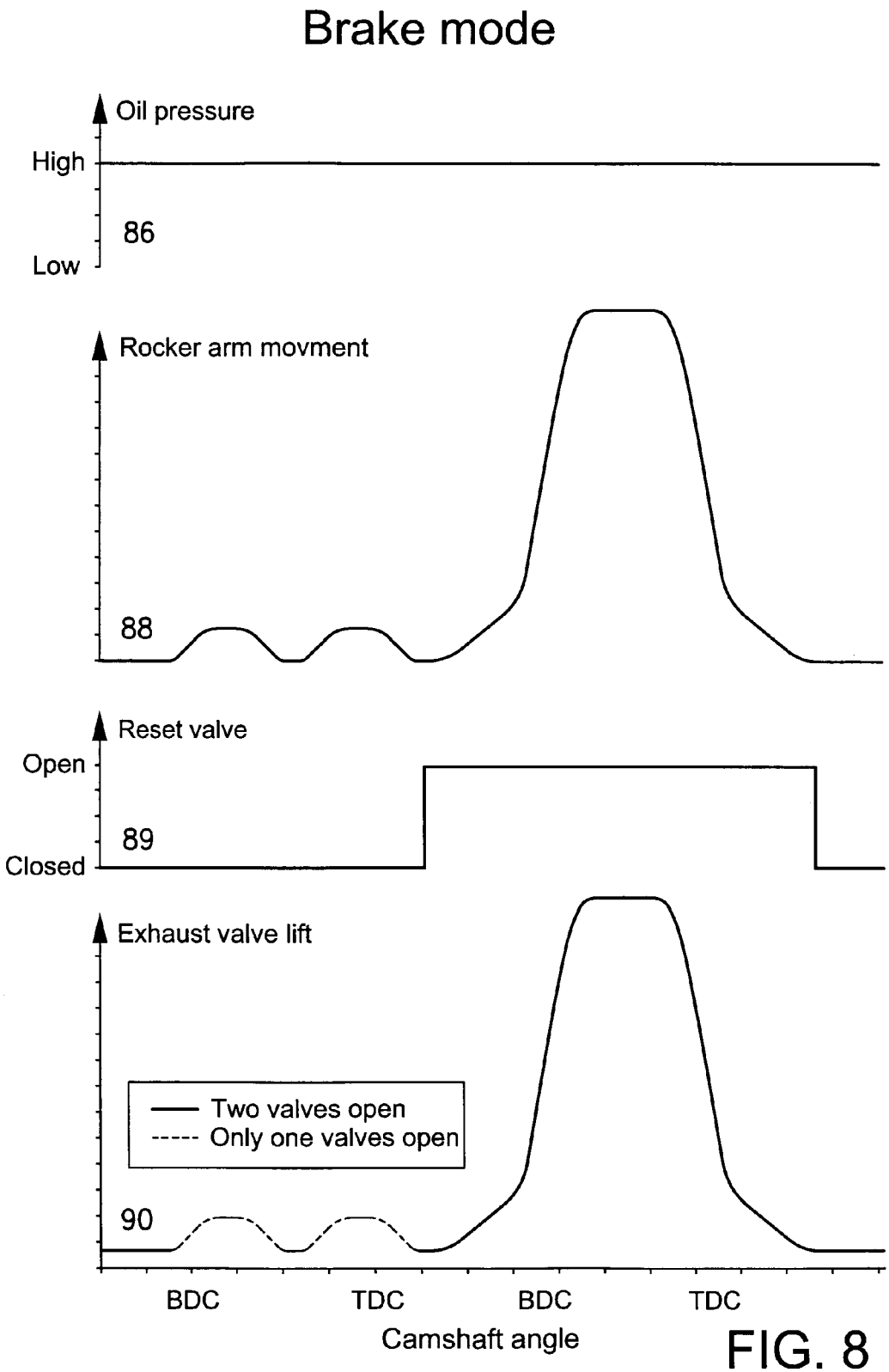
FIG. 8 shows the rocker arm movement and exhaust valve lift during an engine brake mode.

FIG. 8 shows the rocker arm movement and exhaust valve lift during an engine brake mode. It should be noted that the brake fluid pressure from the control valve is high during the entire operation as indicated in the upper diagram 86. The rocker arm movement indicated in the middle diagram 88 reflects the shape of the gas exchange cam element and includes lobes defining a main exhaust lift 78 and two engine brake lifts 80, 82. The rocker arm movement is independent on whether an engine brake mode or a normal power mode is present. Since the pressure is high in the actuator cylinder, the gas exchange valve can be opened by the movement of the rocker arm. The shape of the reset valve cam element will however enable release during the main lobe 78 such that low pressure brake fluid trapped in the actuator cylinder does not prevent the actuator piston to assume a base position which precisely defines the intended lift of the exhaust valve during power stroke. The reset valve is therefore open during the complete exhaust lift portion. Preferably the reset valve opens before the entry of the main lobe 78. As indicated in the figure, the reset valve opens after the end of the second engine brake lobe 82 and before the main lobe 78. The state of the reset valve is shown in diagram 89. Here it is apparent that in the shown embodiment the reset valve opens before the opening of the exhaust valve and closes after closing of the exhaust valve. The resulting exhaust valve lift is shown in the lower diagram 90. The opening of the reset valve has a longer duration than the exhaust lobe. It is however possible to use an exhaust cam element for defining the opening of the reset valve if an arc shaped cam element as shown in FIG. 1 is used, since the cam element allows for an extended contact between a peak of a cam lobe and the cam follower. The same shape of the cam lobe will thus generate a longer lift period.

The invention claimed is:

1. Valve mechanism for an internal combustion engine operable to selectively open and close an gas exchange valve to accomplish an engine brake during an engine brake mode of the engine, the valve mechanism comprising:

a first cam follower in biased abutment against a gas exchange cam element for actuation of a rocker arm connected to the gas exchange valve; and a reset valve actuator with a second cam follower in biased abutment against a reset valve cam element for actuation of a reset valve, wherein the reset valve actuator includes a reset member which is pivotally supported around an axis which is parallel and off set in relation to a pivot axle for the rocker arm.

2. Valve mechanism according to claim 1, wherein the gas exchange cam element being arranged on a cam shaft and including a main lift portion and at least one brake lift portion.

3. Valve mechanism according to claim 1, wherein the valve mechanism further including an actuator cylinder housing an actuator piston slidably arranged in the actuator cylinder, the actuator piston is arranged in abutment with the gas exchange valve for selective actuation of the gas exchange valve.

4. Valve mechanism according to claim 1, wherein valve mechanism further including a braking fluid circuit, the braking fluid circuit connecting the actuator cylinder with a control valve selectively connecting the braking fluid circuit, to a braking fluid supply line or a braking fluid drain line.

5. Valve mechanism according to claim 4, wherein the reset valve is arranged in the braking fluid circuit to open or close a connection between the actuator cylinder and the control valve.

6. Valve mechanism according to claim 1, wherein the gas exchange valve is an exhaust valve.

7. Valve mechanism according to claim 1, wherein the reset valve cam element and the gas exchange valve cam element are provided on a common cam shaft.

8. Valve mechanism according to claim 1, wherein the reset valve cam element and the gas exchange valve cam element are separate elements.

9. Valve mechanism according to claim 1, wherein a single cam element forms the reset valve cam element and the gas exchange valve can element.

10. Valve mechanism according to claim 1, wherein the second cam follower includes an arced concave portion faced toward the cam element.

11. Valve mechanism according to claim 1, wherein the reset member is arranged to be pivoted by the reset valve cam element via the second cam follower.

12. Valve mechanism according to claim 11, wherein the second cam follower is an integral part of the reset member.

13. Valve mechanism according to claim 1, wherein the reset member includes a slot or recess having an extension in a circumferential direction allowing a reset valve stem to remain in an extended position while the second cam follower is positioned on a base circle of the reset valve cam element during movement of the first cam follower around a periphery of the exhaust valve cam element.

14. Valve mechanism according to claim 13, wherein the reset member includes a ramp portion allowing a reset valve stein to transfer between location in the slot or recess where the reset valve stem may be extended to a reset portion area where the reset valve stem is urged to open the reset valve.

15. Valve mechanism according to claim 14, wherein the reset valve stem reaches its fully retracted position at a maximum height of the reset valve cam element.

16. Exhaust valve mechanism for an internal combustion engine comprising:

a cam shaft having an exhaust valve cam element including a main lift portion and at least one brake lift portion, a rocker arm for mounted on a rocker arm shaft, the rocker arm provided with a first cam follower in biased abutment against the cam element for actuation of the rocker arm, an actuator cylinder formed in the rocker arm, the actuator cylinder housing, an actuator piston slidably arranged in the actuator cylinder, the actuator piston is arranged in abutment with an exhaust valve for selective actuation of the exhaust valve, a braking fluid circuit formed in the rocker arm the braking fluid circuit connecting the actuator cylinder with a control valve selectively connecting the braking fluid circuit to a braking fluid supply line or a braking fluid drain line, a reset valve being arranged in the braking fluid circuit to open or close a passage between the actuator cylinder and the control valve, and a reset valve actuator mechanism controlling actuation of the reset valve, wherein the reset valve actuator includes a second ca follower in biased abutment against a reset valve cam element for actuation of the reset valve, wherein the reset valve actuator includes a reset member which is pivotally supported around an axis which is parallel and off set in relation to a pivot axle for the rocker arm.

* * * * *